US006401347B1

(12) United States Patent
Slates

(10) Patent No.: US 6,401,347 B1
(45) Date of Patent: Jun. 11, 2002

(54) LATERALLY TRANSLATABLE ARCHERY BOW SIGHT MOUNT

(75) Inventor: Scott O. Slates, County of St. Charles, MO (US)

(73) Assignee: Toxonics Manufacturing, Inc., Wentzville, MO (US)

( * ) Notice: Subject to any disclaimer, the term of this patent is extended or adjusted under 35 U.S.C. 154(b) by 0 days.

(21) Appl. No.: 09/348,741

(22) Filed: Jul. 6, 1999

(51) Int. Cl.[7] ..... F41G 1/00
(52) U.S. Cl. ..... 33/265; 33/263
(58) Field of Search ..... 33/265, 263, 276, 33/278, 279, 280

(56) References Cited

U.S. PATENT DOCUMENTS

| | | | | | |
|---|---|---|---|---|---|
| 5,414,936 | A | | 5/1995 | Sappington | 33/265 |
| 5,428,901 | A | | 7/1995 | Slates | 33/265 |
| 5,509,402 | A | * | 4/1996 | Sappington | 33/265 |
| 5,524,601 | A | | 6/1996 | Slates et al. | 33/265 |
| 5,657,740 | A | | 8/1997 | Slates et al. | 33/265 |
| 5,694,698 | A | | 12/1997 | Slates | 33/265 |
| 5,722,175 | A | | 3/1998 | Slates | 33/265 |
| RE36,266 | E | * | 8/1999 | Gibbs | 33/265 |
| 6,026,799 | A | * | 2/2000 | Wiseby et al. | 33/265 |
| 6,073,352 | A | * | 6/2000 | Zykan et al. | 33/265 |
| 6,079,111 | A | * | 6/2000 | Williams et al. | 124/87 |
| 6,098,608 | A | * | 8/2000 | Oshlick | 33/265 |
| 6,199,286 | B1 | * | 3/2001 | Reed et al. | 124/87 |

* cited by examiner

*Primary Examiner*—Diego Gutierrez
*Assistant Examiner*—Yaritza Guadalupe
(74) *Attorney, Agent, or Firm*—Paul M Denk

(57) ABSTRACT

An adjustable mount is provided for mounting a bow sight to an arm extending from an archery bow to allow the sight to be moved in two generally perpendicular axes. The mount includes a first slide mounted to the arm and a second slide slideable along the first slide. The sight is slideable along the second slide. The first slide is a generally horizontal slide, and the second slide is a generally vertical slide. However, the orientation of the two slides could be reversed. Each slide includes a fixed portion and a movable portion. The fixed portion of the first slide is mounted to the arm, and the fixed portion of the second slide is mounted to the first slide movable portion. The fixed portion includes a track defining a generally T-shaped channel. A generally T-shaped block is received in the channel to be movable along the track. The block includes a first hole which is generally parallel to the axis of the channel and a post which extends from the block of the channel. The movable portion of the slide is mounted to the post. A shaft extends through the block first hole; whereby, rotation of the shaft in one direction causes the block, and hence the movable portion, to move along the track in one direction, and rotation of the shaft in a second direction causes the block, and hence the movable portion, to move along the track in a second direction.

15 Claims, 4 Drawing Sheets

FIG. 2
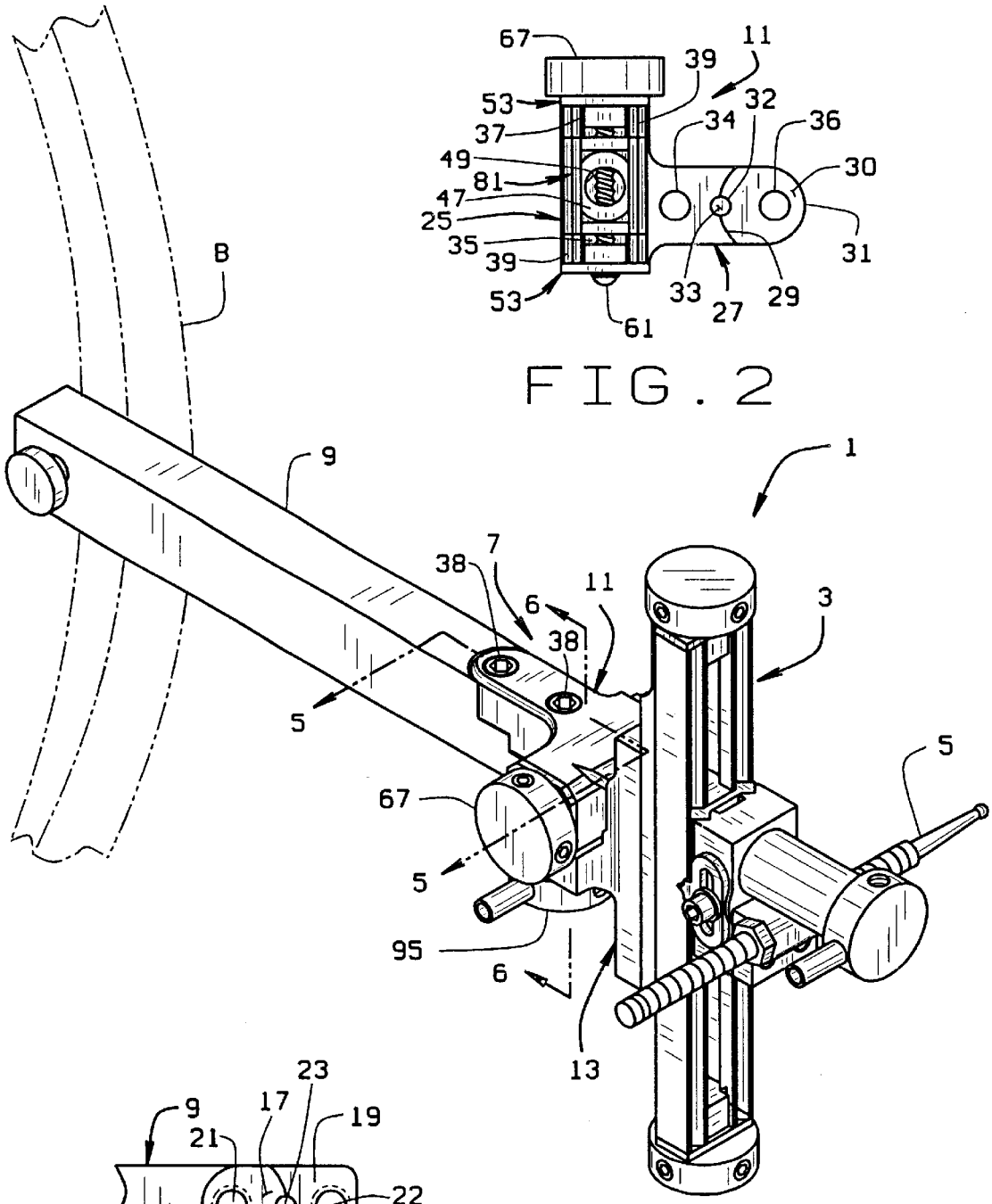
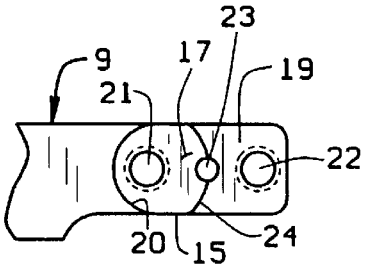
FIG. 3
FIG. 1

LATERALLY TRANSLATABLE ARCHERY BOW SIGHT MOUNT

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates generally to mounts for archery bow sights, and in particular to an improved adjustable bow sight mount which allows for the sight to be adjusted laterally (i.e., in a plane generally perpendicular to the bow).

Bow hunters typically use pin sights when hunting game. The pin sight includes at least one pin which is positioned on the bow and is used to aim at the target, such as a deer or a target. Before an archer hunts, the pin is positioned on the bow to indicate a certain distance, i.e., 100 yards. If the archer is to shoot at game at a different distance, the pin will have to be repositioned with respect to the bow, i.e., it will have to be moved vertically. Additionally, there are times when the pin has to be moved horizontally or laterally relative to the bow. In either of these instances, it is important that the pin remain generally perpendicular to the plane of the bow. On many bow sight mounts, when the pin is repositioned, the design of the mount does not ensure that the pin will remain in the desired perpendicular position.

U.S. Pat. Nos. 5,414,936, 5,524,601, 5,509,402, 5,657,740, 5,694,698, and 5,722,175, all of which are assigned to the same assignee of the current invention, and all of which are incorporated herein by reference, disclose pin mounts which maintain the pin perpendicular to the plane of the bow during vertical adjustment of the pin or sight. However, there are times when an archer needs to adjust the position of the pin sight mount relative to the bow.

BRIEF SUMMARY OF THE INVENTION

An adjustable mount is provided for mounting a bow sight to an arm extending from an archery bow to allow the sight to be moved in two generally perpendicular axes. The mount includes a first generally horizontal slide mounted to the arm and a second generally vertical slide slideable along the first slide. The sight is slideable along the second slide. The first slide is a generally horizontal slide, and the second slide is a generally vertical slide. However, the orientation of the two slides could be reversed.

Each slide includes a fixed portion and a movable portion. The fixed portion of the first slide is mounted to the arm, and the fixed portion of the second slide is mounted to the first slide movable portion. The fixed portion includes a track defining a generally T-shaped channel. A generally T-shaped block is received in the channel to be movable along the track. The block includes a first hole which is generally parallel to the axis of the channel and a post which extends from the block of the channel. The movable portion of the slide is mounted to the post. A shaft extends through the block first hole; whereby, rotation of the shaft in one direction causes the block, and hence the movable portion, to move along the track in one direction, and rotation of the shaft in a second direction causes the block, and hence the movable portion, to move along the track in a second direction.

Preferably, the post is formed independently of the block. The block thus includes a second hole, generally perpendicular to the axis of the channel, in which the post is received. The post includes a threaded hole near the its end which is received in the block. The shaft extends trough the post hole. The shaft cooperates with the post to move the block, and hence the movable portion, relative to the fixed portion as the shaft is rotated.

The post has a threaded end which extends through a hole in the movable portion. A lock knob is threaded on to a free end of the post. When the lock knob is tightened against the movable portion, the block is pulled against a surface of the channel creating a frictional interference between the channel and the block which substantially prevents movement of the block, and hence the movable portion, relative to the slide.

To maintain the movable portion in alignment with the fixed portion, and especially the track of the fixed portion, the fixed portion and movable portion both include grooves which are generally parallel with the axis of the channel. A fitting is mounted to the block. The fitting has rails which are received in the grooves of the fixed and movable portions of the slide.

BRIEF DESCRIPTION OF THE SEVERAL VIEWS OF THE DRAWINGS

FIG. 1 is a perspective view of a bow sight present invention, incorporating a two-part mount of the present invention;

FIG. 2 is a bottom plan view of a rear portion of the mounting assembly;

FIG. 3 is a fragmentary top plan view of the bow sight mounting arm;

Corresponding reference numerals will be used throughout the several figures of the drawings.

DETAILED DESCRIPTION OF THE INVENTION

Figure 4:
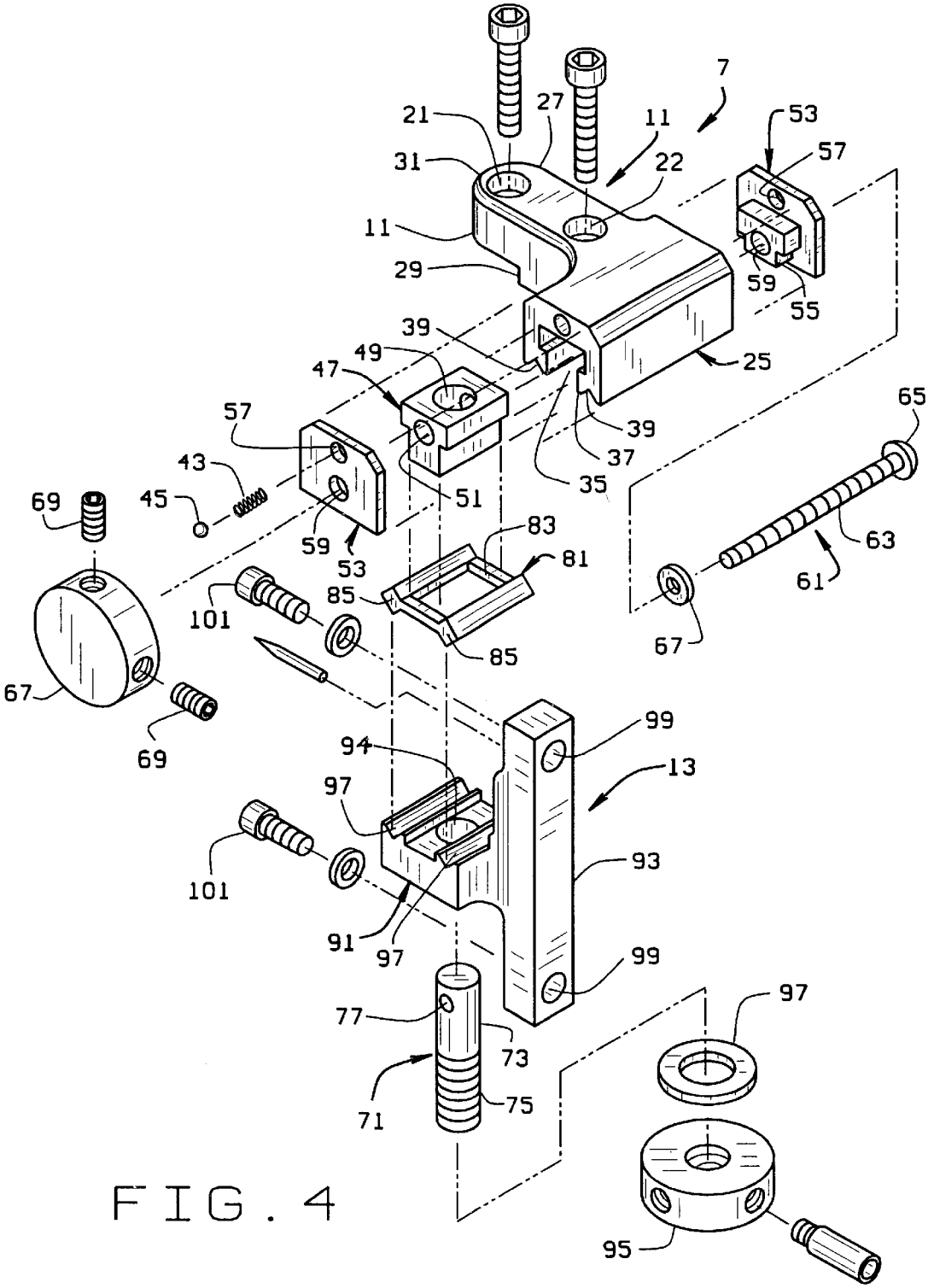
FIG. 4 is an exploded view of the slide mounting assembly which permits lateral adjustment of the pin mount relative to the bow.

The following detailed description illustrates the invention by way of example and not by way of limitation. This description will clearly enable one skilled in the art to make and use the invention, and describes what I presently believe is the best mode of carrying out the invention.

Referring initially to FIG. 1, the sight 1 includes a generally vertical slide 3 to which a pin 5 is mounted. The pin 5 is mounted to the vertical slide 3 so that the pin can be moved vertically along the slide, for example, as set forth in my above noted patents. The slide 3, in turn, is mounted on a two-piece mounting assembly 7. The two-piece mounting assembly, in turn, is mounted to an arm 9, and the arm 9 is mounted to a bow B. The arm 9 can be mounted to the bow B in any conventional manner. For example, it could be mounted in accordance with my prior U.S. Pat. No. 5,428,901, which is incorporated herein by reference. As will be discussed below, the two-piece mounting assembly 7, forms a horizontal slide which allows the vertical slide 3 to be moved perpendicularly relative to the axis bow. That is, when the bow is held vertically, the slide 3 can be moved horizontally.

The two-piece mounting assembly 7 is shown in more detail in FIGS. 2–6. It includes a fixed rear member 11 which is fixedly mounted to the arm 9, and a moveable forward member 13 to which the slide 3 is mounted. The arm 9 is stepped at its forward end 15, and defines a pair of shoulders 17 and 19. The shoulder 17 is above and shorter than the shoulder 19. Screw holes 21 and 22 are formed in each of the shoulders. The back edge of each shoulder is preferably curved. The back edge 20 of the upper shoulder is concavely curved and the back edge 24 of the lower shoulder is convexly curved. A pin hole 23 is formed on the lower shoulder 19 at the edge 24. Thus, the edge 24 essentially bisects the pin hole 23.

The rear member 11 of the mounting assembly 7 includes a track 25 and an arm 27 extending rearwardly from the track. The arm 27 is stepped, as at 29, to define a shoulder 30. The arm step 29 corresponds in size and shape to the edge or surface 24 between the shoulders 17 and 19 on the mounting arm 9 so that the mounting assembly rear member 11 will fit on the arm 9. Thus step 29 is curved. Similarly, the back surface 31 of the arm 27 is curved to correspond to the shape of the curvature of the back surface 20 of the upper shoulder 17. A hole 32 is positioned to be bisected by the surface 29, and corresponds in position to the hole 23 in the arm 9. A pin 33 is received in the holes 32 and 23 to help align the member arm 27 on the mounting arm 9. Screw holes 34 and 36 are formed on the arm 27 which are aligned with the screw holes 21 and 22 in the arm 9. Screws 38 pass through the screw holes 34 and 36 to be threaded into the screw holes 21 and 22 to secure the rear member 11 to the arm 9.

The track 25 of the mounting assembly rear member 11 extends generally perpendicularly to the arm 27. It has a generally T-shaped channel 35 extending the length of the track which is opens along its bottom surface 37. A generally V-shaped channel or groove 39 extends the length of the track 25 on either side of the opening of the T-shaped channel 35. A bore 41 is formed in one side of the track 25 above the T-shaped channel 35. A spring 43 and ball 45 are received in the bore.

A generally T-shaped block 47 is slidingly received in the T-shaped channel 35 of the rear member track 25. The block 47 corresponds in shape to the T-shaped channel 35. However, its dimensions are smaller so that it can freely slide along the channel. The block 47 includes a generally vertical cylindrical passage 49 and a generally horizontal cylindrical passage 51. The passages 49 and 51 extend through the block 47. The passages 49 and 51 are perpendicular to each other and intersect each other. The passage 49 is shown to have a larger diameter than the passage 51, however, the ratio of the sizes of the two passages can be changed.

The channel 35 is closed on either side by an end cap 53. The caps 53 each have a T-shaped projection 55 on their inner surfaces. The projections 55 correspond in shape to the T-shaped channel 35, and are sized so that the projections 55 will frictionally engage the channel 35 to frictionally hold the caps 53 to the slide 25. The two caps are identical. They include an upper opening 57 positioned to be aligned with the bore 41 on the slide, and a lower opening 59 which is positioned to be aligned with the passage 51 of the block 47. A screw 61 passes through the end cap openings 59 and the passage 51 of the block 47 so that its threaded shaft 63 extends out of the slide 25 on the side having the spring 43 and ball 45. The screw head 65 is adjacent the opposite end cap 53. A washer 67 is positioned between the screw head 65 and the end cap 53. A knob 67 is received on the end of the screw shaft 63 and is rotationally fixed to the screw shaft 63 by set screws 69. The set screws 69 pass through threaded openings in the side of the knob 67 to bear against the screw shaft 69. Thus, when the knob 67 is rotated, the screw 61 will be rotated.

A post 71 has an upper portion 73 and a lower portion 75. The upper portion 73 has a smooth outer surface and a threaded hole 77 extending radially therethrough. The lower portion 75 is externally threaded. The post 71 is generally cylindrical and of constant diameter. The upper portion 73 is received in the opening 49 of the T-shaped block 47. The screw shaft 63 passes through threaded the post hole 77. The threads in the post hole 77 mate with the threads of the screw 61. Thus, when the screw 61 is rotated, the post 71, and hence the block 47, will move along the track channel 35.

Figure 5:
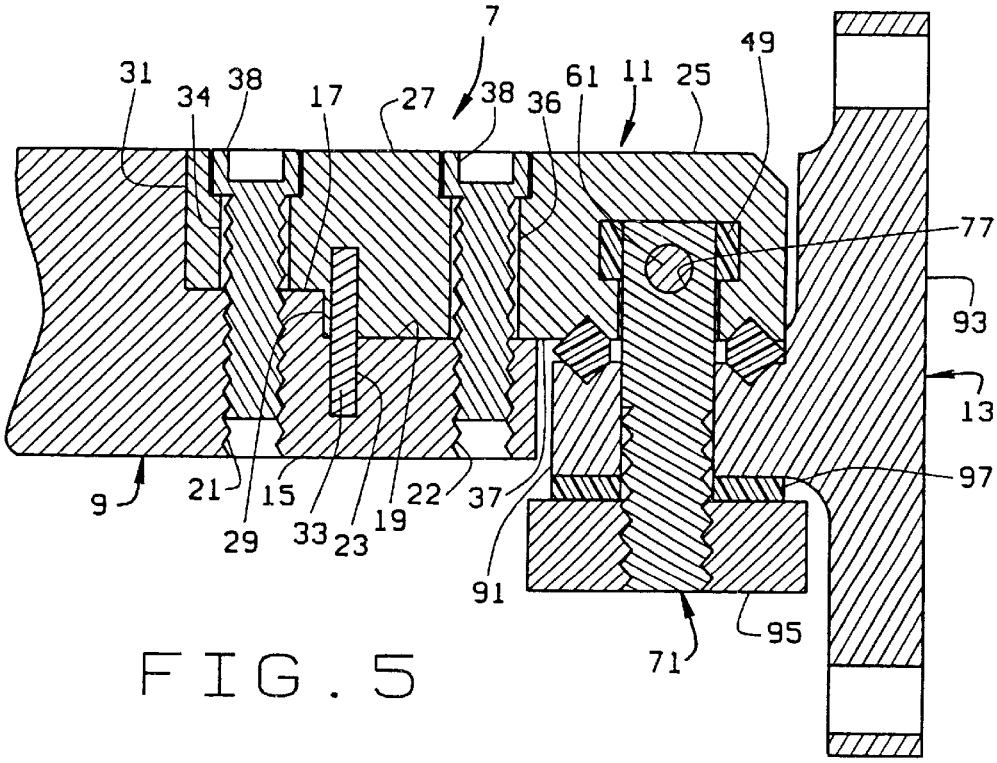
FIG. 5 is an enlarged cross-sectional view of the slide mounting assembly taken along line 5—5 of FIG. 1.
Figure 6:
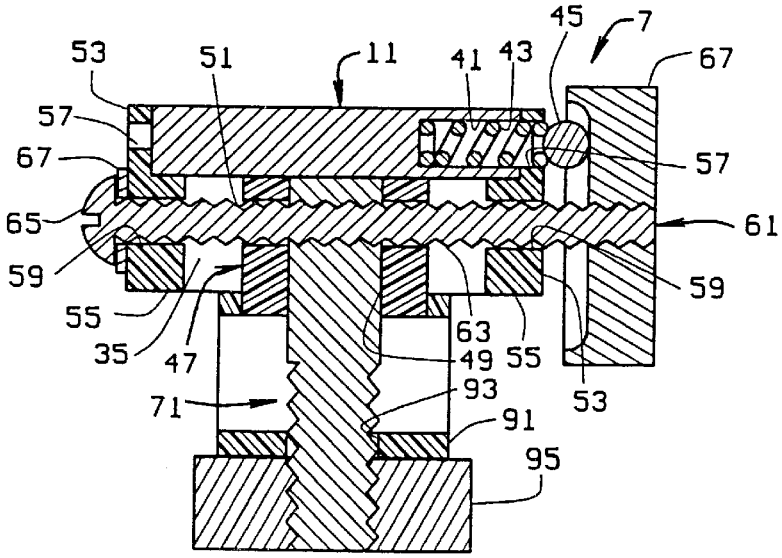
FIG. 6 is an enlarged cross-sectional view of the slide mounting assembly taken along line 6—6 of FIG. 1.
Figure 7:
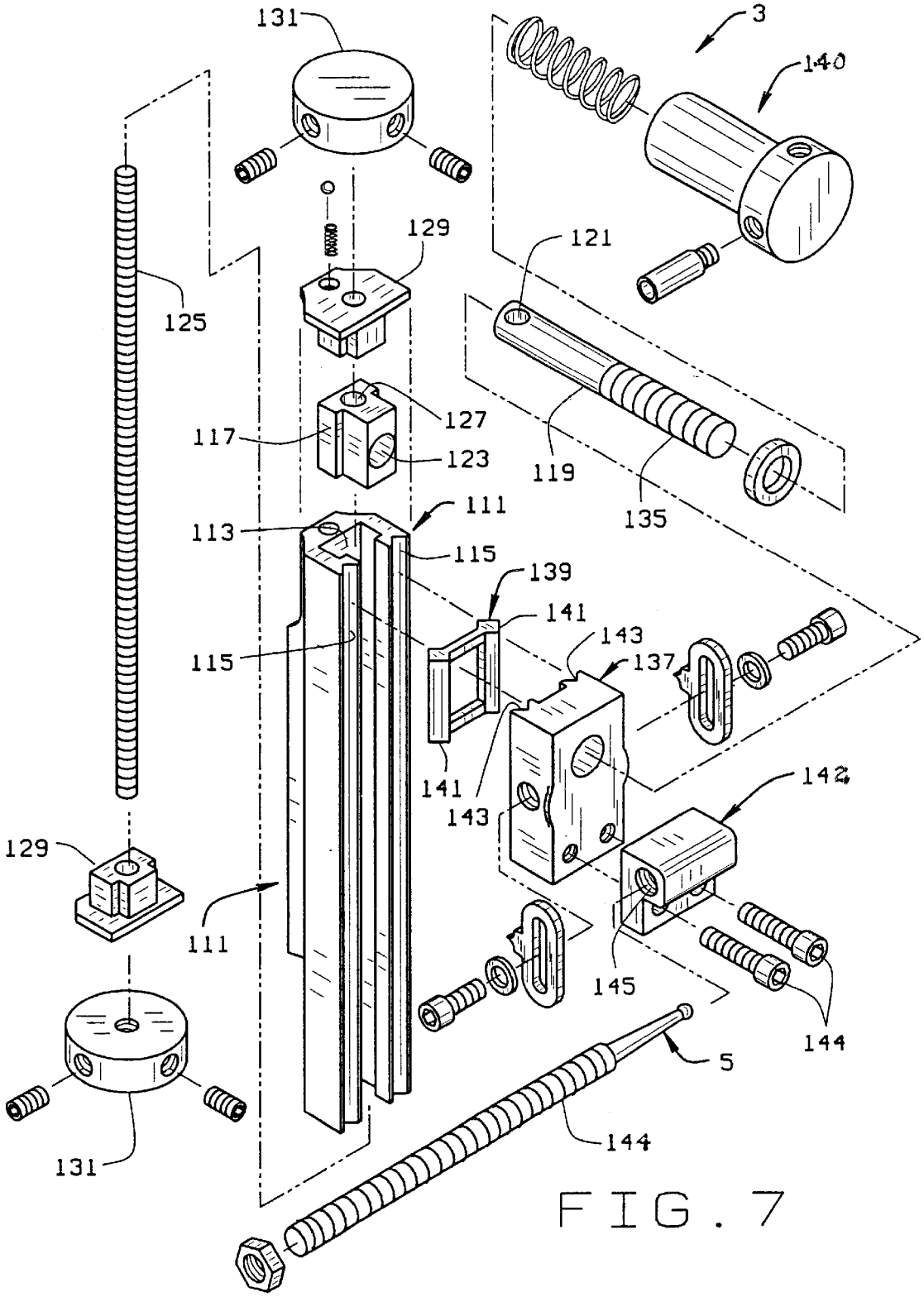
FIG. 7 is an exploded view of the pin mount assembly of the invention which permits vertical adjustment of the pin relative to the bow.

As seen in FIGS. 5 and 6, the leg of the T-shaped block 47 extends a short distance beyond the bottom 35 of the track 25. A rectangular fitting 81 has a rectangular opening 83 which is sized to fit about the leg of the T-shaped block 47. The fitting 81 also has generally diamond shaped rails 85 on opposite sides thereof. The upper surface of the rails 85 are sized and shaped to be received in the V-shaped grooves 37 of the track 25.

The forward part 13 of the two-part mounting assembly includes a sled 91 which moves along the track 25, as will be discussed. A mounting post or arm 93 extends from the sled 91. The vertical slide 3 is mounted to the post 93. The sled 91 includes an opening 94 through which threaded portion 75 of the pin 71 passes. A locking knob 95 is threaded onto the end of the pin 71. The pin 71 thus connects the sled 91 to the t-block 47. Hence, the sled, or horizontal slide, can be moved along the track 25. A washer 97 is positioned between the knob 95 and the bottom of the slide 91. By tightening the knob 95 against the bottom of the sled 91, the T-shaped block 47 will be pulled downwardly, and brought into frictional contact with the surfaces of the T-shaped channel 35. Thus, the T-shaped block will not be able to be moved along the slide 25. The sled 91 of the mounting assembly forward portion 13 also includes a pair of V-shaped grooves 97 on opposite sides of the hole 94. The grooves 97 are positioned to receive the bottom surfaces of the rails 85 of the fitting 81.

The mounting post 93 is generally perpendicular to the sled 91. It includes a pair of bolt holes 99 through which bolts 101 pass. The bolts 101 are received in the back of the pin slide 3 to mount the pin slide 3 to the forward portion 13 of the two-part mounting assembly 7. Thus, as can be appreciated, by rotating the knob 67, the vertical slide 3 can be moved laterally or horizontally, relative to the bow. By tightening the lock knob 95, the vertical slide 3 will be generally locked in place relative to the bow. Should it be desired to change the lateral position of the vertical slide relative to the bow, the lock knob 95 is loosened, and the adjusting knob 67 can be rotated to move the vertical slide 3. When the vertical slide 3 is in a desired location, the lock knob 95 can be tightened again to hold the pin slide 3 in its new desired location.

The vertical slide 3 is constructed similarly to the mounting assembly 7. It includes a fixed portion of track 111 which is mounted to the sled post 93. The track 111 includes an opened T-shaped channel 113 and V-shaped grooves 115 on either side of the channel 113. A block 117 is slidably received in the channel 113. A post 119 having a threaded hole 121 is received in a first hole 123 in the block 117. A threaded shaft 125 extends through the slide channel, a second hole 127 in the block 117 and the post's threaded hole 121. The threaded shaft is held in the track 111 by end caps 129. Knobs 131 are fixed to opposite ends of the shaft. As the knobs are rotated, the shaft rotates in the channel 113, causing the block 117 to move along the channel 113, and hence the track 111.

The pin 119 has a threaded end 135 which extends through a sled 137 the sled 137 forms a movable portion of the slide 3 on which pin 5 is mounted, as discussed below. A fitting 139 with diamond shaped rails 141 fits about the block 117. The rails 141 are received in the track grooves 115, and corresponding grooves 143 in the sled 137. The pin's threaded shaft 135 extends through the sled 137 and a locking member 140 is screwed onto the pin shaft 135. The locking member 140 secures the sled 137 to the pin shaft 135, and hence to the track block 127. Thus, as the sled 137 will move with the block 127. By tightening down on the locking member 140, movement of the block 127, and hence the sled 137, will be substantially prevented.

A pin mounting block 142 is mounted to the sled 137 by screws 144. The pin 5 has a threaded shaft 143, and the mounting block 141 has a threaded hole 145 through which the pin shaft 143 is threaded.

As various changes could be made in the above constructions without departing from the scope of the invention, it is intended that all matter contained in the above description or shown in the accompanying drawings shall be interpreted as illustrative and not in a limiting sense. For example, although the pins 71 and 119 are formed separately from the blocks 47 and 117, respectively, the pins could be integrally formed with the blocks. In this case, the holes 51 and 127 of the blocks 47 and 117, respectively, would be at least partially internally threaded, so that upon rotation of the respective threaded shaft, the blocks would move along their respective tracks. The fittings 81 and 139 could be eliminated and replaced with projections or rails the sleds which would ride in the grooves of the tracks. Alternatively, the rails could be on the tracks, and the grooves could be on the sleds. These examples are merely illustrative.

What is claimed is:

1. A mount for mounting a bow sight to an arm extending from an archery bow; the mount including a first horizontal slide mounted to the arm, a second vertical slide slideable along the first slide; and a mounting block slideable vertical along the second slide, said block being generally a T-shaped block that fits within a channel, said channel being a T-shaped channel formed within tracks; the bow sight being mounted to the mounting block; the first and second slides being perpendicular to each other; one of said slides being generally vertical and the other being generally horizontal, whereby, the bow sight can be moved in two axes.

2. The mount of claim 1 wherein each slide includes a fixed portion and a movable portion; the fixed portion of the first slide being mounted to the arm, and the fixed portion of the second slide being mounted to the movable potion or the first slide.

3. The mount of claim 2 wherein the fixed portion of each slide includes one of said tracks defining said channel, said track having an axis; said block received in the channel to be movable along the track, the block including a first hole which is generally parallel to the axis of the channel; a post which extends from the block and out of the channel; and a threaded shaft which extends through the block first hole; the movable portion of each slide being mounted to the post of the respective slide; whereby, rotation of the shaft in one direction causes the block, and hence the movable portion, to move along the track in one direction, and rotation of the shaft in a second direction causes the block, and hence the movable portion, to move along the track in a second direction.

4. The mount of claim 3 wherein the block includes a second hole generally perpendicular to the axis of the channel; the post being received in the block second hole; the post including a threaded hole through which the threaded shaft extends; the shaft cooperating with the post to move the block, and hence the movable portion, along the track.

5. The mount of claim 3 wherein the movable portion of each slide includes a hole through which the post extends; and a lock knob which is threaded on to a free end of the post; whereby, by tightening of the lock knob against the movable portion, movement of the movable portion along the channel is substantially restricted.

6. The mount of claim 5 wherein the block is pulled against a surface of the channel when the lock knob is tightened against the movable portion.

7. The mount of claim 3 including one of a groove or a rail extending along a surface of said fixed portion generally parallel to said channel; said movable portion including the other of said groove and rail; whereby, said rail rides in said groove as said movable portion is moved relative to said fixed portion.

8. The mount of claim 7 wherein both said fixed portion and said movable portion include a groove; said mount including a fitting which engages the block; the fitting including rails which are received in the grooves of said fixed and movable portions.

9. An adjustable mount for mounting an archery bow sight to a bow; the mount be adjustable in two axis, the mount includes a horizontal slide and a vertical slide; each said slide including a fixed portion and a movable portion; the fixed portion of a first of said horizontal and vertical slides being mounted to an arm extending from the bow; and, the fixed portion of the other of said horizontal and vertical slides being mounted to the movable portion of the first of said horizontal and vertical slides; wherein the fixed portion of each of said slide includes a track defining a channel, the channel being a T-shaped channel and having an axis, a block received in the channel to be movable along the track, said block being generally T-shaped.

10. The mount of claim 9 wherein the block includes a first hole which is generally parallel to the axis of the channel; a post which extends from the track out of the channel; and a threaded shaft which extends through the block first hole; the movable portion being mounted to the post; whereby, rotation of the shaft in one direction causes the block, and hence the movable portion, to move along the track in one direction, and rotation of the shaft in a second direction causes the block, and hence the movable portion, to move along the track in one direction.

11. The mount of claim 10 wherein the block includes a hole generally perpendicular to the axis of the channel; the post being received in the block hole; the post including a threaded hole through which the threaded shaft extends; the shaft cooperating with the post to move the block, and hence the movable portion, along the track.

12. The mount of claim 10 wherein the movable portion includes a hole through which the post extends; the mount including a lock knob which is threaded on to a free end of the post; whereby, by tightening of the lock knob against the movable portion, movement of the movable portion along the channel is substantially restricted.

13. The mount of claim 12 wherein the block is pulled against a surface of the channel when the lock knob is tightened against the movable portion.

14. The mount of claim 10 including one of a groove or a rail extending along a surface of said fixed portion generally parallel to said channel; said movable portion including the other of said groove and rail; whereby, said rail rides in said groove as said movable portion is moved relative to said fixed portion.

15. The mount of claim 14 wherein both said fixed portion and said movable portion include a groove; said block including a portion extending from said channel; said mount including fitting which is received on the block; the fitting including rails which are received in the grooves of said fixed and movable portions.

* * * * *